US009993068B2

(12) United States Patent
Lin et al.

(10) Patent No.: US 9,993,068 B2
(45) Date of Patent: Jun. 12, 2018

(54) ELECTRICAL ADJUSTABLE TABLE AND CONTROL METHOD FOR ELECTRICAL ADJUSTABLE TABLE

(71) Applicant: TIMOTION TECHNOLOGY CO., LTD., New Taipei (TW)

(72) Inventors: Dong-Jye Lin, New Taipei (TW); Chou-Hsin Wu, New Taipei (TW); Pen-Chih Chou, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 133 days.

(21) Appl. No.: 14/979,209

(22) Filed: Dec. 22, 2015

(65) Prior Publication Data

US 2016/0309889 A1 Oct. 27, 2016

(30) Foreign Application Priority Data

Apr. 23, 2015 (TW) ..... 104113117 A
Aug. 24, 2015 (TW) ..... 104127571 A

(51) Int. Cl.
*A47B 9/00* (2006.01)

(52) U.S. Cl.
CPC ..... *A47B 9/00* (2013.01); *A47B 2200/0062* (2013.01)

(58) Field of Classification Search
CPC ..... A47B 9/00; A47B 9/20; A47B 2009/003; A47B 2009/043; A47B 2009/046; A47B 2200/005; A47B 2200/0051; A47B 2200/0056; A47B 2200/0057; A47B 2200/0058; A47B 2200/0059; A47B 2200/006; A47B 2200/0061; A47B 2200/0062; A47B 2200/0063; A47B 2200/0065; A47B 2200/0086; A47B 2200/0087; A47B 2200/0088
See application file for complete search history.

(56) References Cited

U.S. PATENT DOCUMENTS 7,677,678 B2 * 3/2010 Mosel
2001/0048372 A1 12/2001 Tomich
(Continued)

FOREIGN PATENT DOCUMENTS

DE 202006018530 * 3/2007 ..... A47B 9/00
DE 202006018530 U1 3/2007
(Continued)

OTHER PUBLICATIONS

Office Action dated Jan. 8, 2016 of the corresponding Taiwan Utility Model application.
(Continued)

*Primary Examiner* — Jose V Chen
(74) *Attorney, Agent, or Firm* — Chun-Ming Shih; HDLS IPR Services

(57) ABSTRACT

An electrical adjustable table having a table plate, a table foot, a lifting structure, a hand control device, a motion sensor unit, and a control box is provided. The electrical adjustable table adjusts a height of the table plate heading to a first direction after receiving an operation sent via the hand control device, and stops adjusting the height of the table plate after sensing the table plate is tilted via the motion sensor unit during adjusting the height of the table plate.

13 Claims, 15 Drawing Sheets

(56) References Cited

U.S. PATENT DOCUMENTS

| | | | |
|---|---|---|---|
| 2005/0082997 | A1 | 4/2005 | Koch |
| 2009/0078167 | A1* | 3/2009 | Ellegaard |
| 2013/0293173 | A1 | 11/2013 | Strothmann et al. |
| 2014/0096706 | A1* | 4/2014 | Labrosse |
| 2016/0106205 | A1* | 4/2016 | Hall |

FOREIGN PATENT DOCUMENTS

| | | | |
|---|---|---|---|
| DE | 102006038558 | A1 | 4/2008 |
| TW | M350282 | U | 2/2009 |
| TW | M491562 | U | 12/2014 |
| WO | 03056976 | A1 | 7/2003 |

OTHER PUBLICATIONS

Search Report dated Nov. 8, 2016 of the corresponding Finnish patent application.

* cited by examiner

ELECTRICAL ADJUSTABLE TABLE AND CONTROL METHOD FOR ELECTRICAL ADJUSTABLE TABLE

TECHNICAL FIELD

The present invention relates to a control method and more particularly relates to a control method of an electrical adjustable table.

BACKGROUND

Different users have different heights and body shapes. When a normal table or a desk is used, if its table plate may be adjusted to a proper height, users may feel more comfortable when using the table or the desk. Therefore, there are several adjustable mechanisms disposed on a table or a desk for automatically adjusting a table plate or the height of a table plate for users of different heights and body shapes.

Currently, tables with height adjusting function mainly use mechanisms like a pneumatic cylinder lifting structure, a hydraulic actuating cylinder lifting structure, a screw thread lifting structure, a gear wheel lifting structure, or a lever lifting structure to adjust the height of a table plate. However, no matter what type of adjusting mechanism is used, when adjusting the height or a horizontal position of a table plate, users often lose sight of noticing whether there is an obstacle staying below or above the table plate. Therefore, it is often to occur that a table plate hits an obstacle below or above the table plate, causing the table plate tilted and causing objects on the table plate fallen, damages of an adjusting mechanism or the obstacle.

SUMMARY OF INVENTION

A major objective of the present invention is to provide a control method of an electrical adjustable table with automatic detection of whether a collision occurs at the table plate and starts damage prevention mechanism automatically when collision occurs.

To achieve the objective, a control method of an electrical adjustable table is disclosed for use in an electrical adjustable table and may include following steps. A). Initialize an internal setting value or a user setting value. B). Enter a static status. C). Use a hand control device to receive an operation, and extend or shrink at least one table foot of the electrical adjustable table in a first direction according to the operation to adjust the height of a table plate of the electrical adjustable table. D). Stop adjusting the height of the table plate when at least one motion sensor unit of the electrical adjustable table detects the table plate tilted during adjusting the height of the table plate.

In addition, an electrical adjustable table is disclosed. The electrical adjustable table includes a table plate and at least one table foot connected and moving together with the table plate. The electrical adjustable table includes a lifting structure for extending or shrinking the table foot to adjust the height of the table plate. The electrical adjustable table includes a hand control device for receiving an operation and includes a motion sensor unit. The electrical adjustable table also includes a control box disposed to the table plate and disposed at the same side as the table foot. The control box is electrically connected to the lifting structure, the hand control device and the motion sensor unit. The control box drives the lifting structure according to the operation in a first direction to adjust the height of the table plate. Also, when the motion sensor unit senses the table plate tilted during adjusting the height of the table plate, the lifting structure is stopped driven to stop adjusting the height of the table plate.

These embodiments effectively prevents the table plate from lifting continuously after hitting an obstacle, causing an object on the table plate fallen, damage of the obstacle or malfunction of the electrical adjustable table.

DETAILED DESCRIPTION

A preferred embodiment according to the present invention is disclosed with associated drawings as follows.

Figure 1:
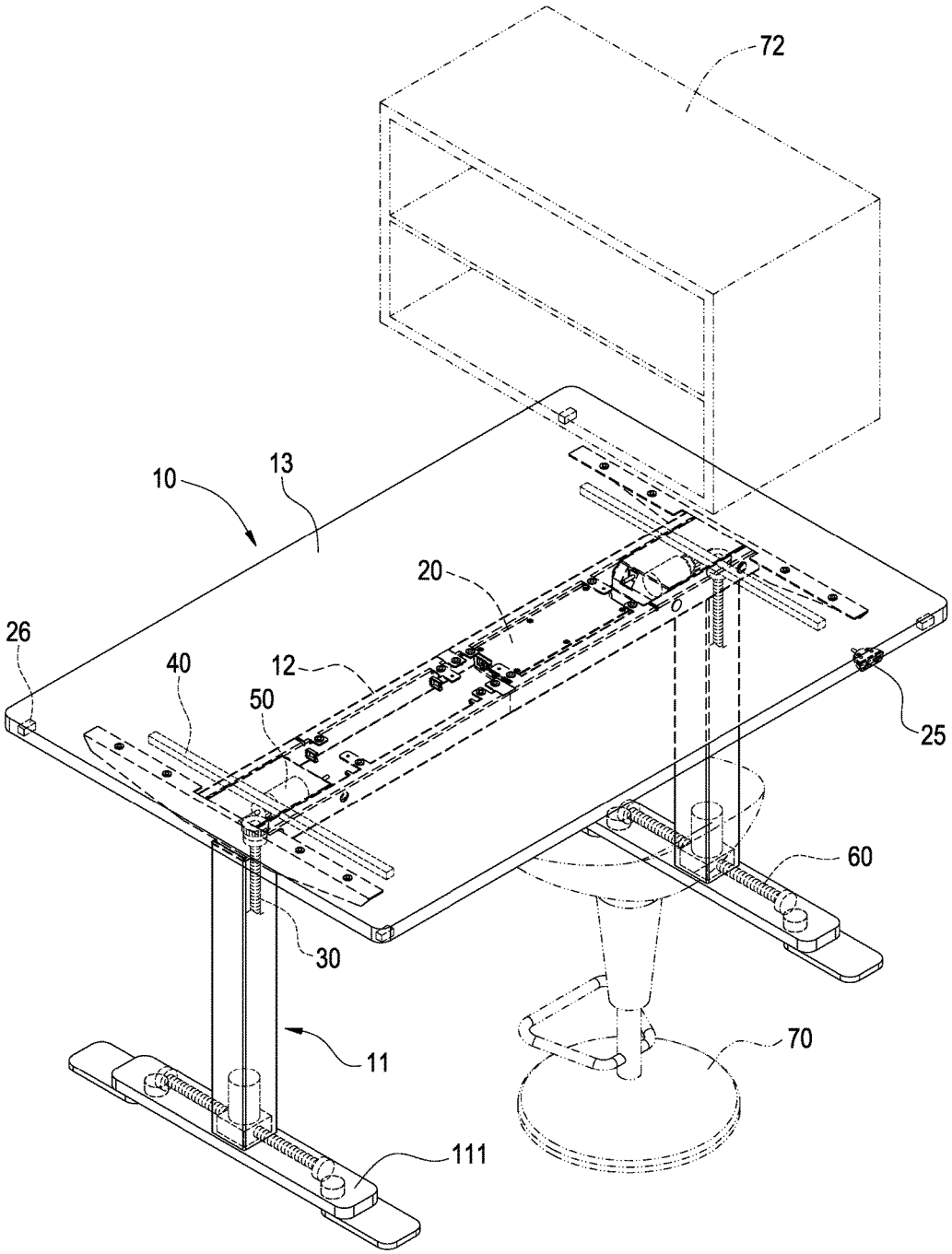
FIG. 1 is a setting diagram of an electrical adjustable table according to a first embodiment of the present invention.
Figure 2:
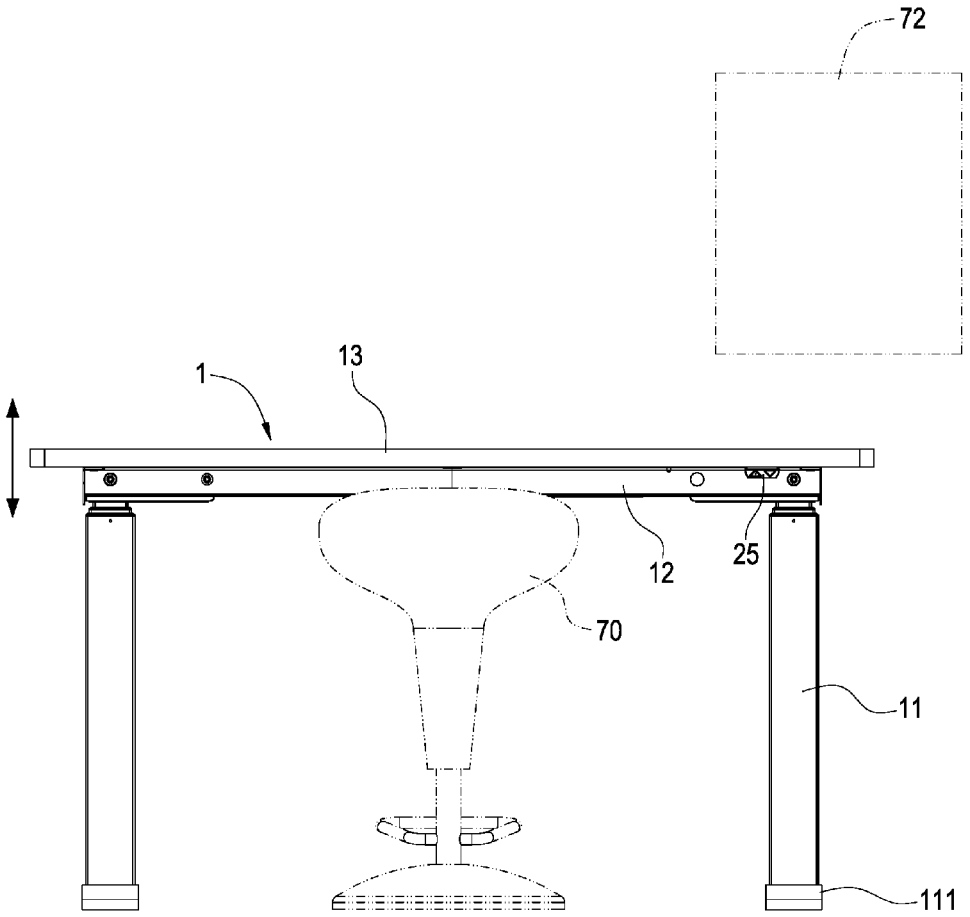
FIG. 2 is a lifting adjusting diagram of an electrical adjustable table of the first embodiment according to the present invention.
Figure 3:
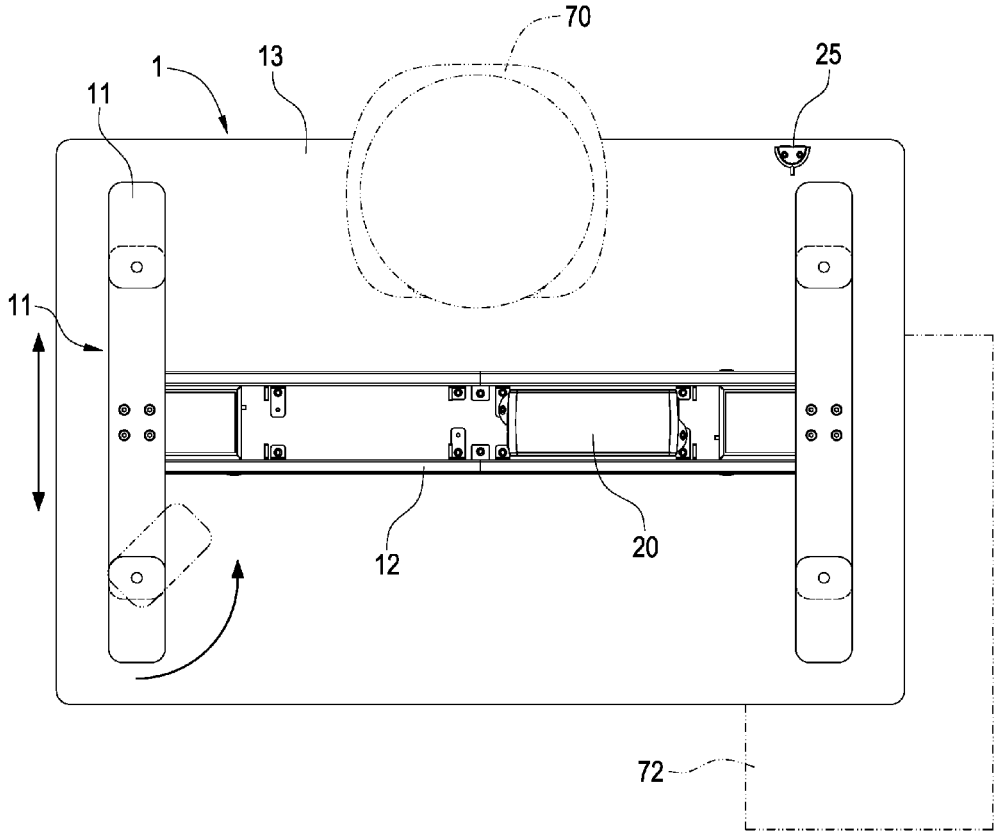
FIG. 3 illustrates horizontal movement of an electrical adjustable table and motion of a table corner in the first embodiment according to the present invention.
Figure 4:
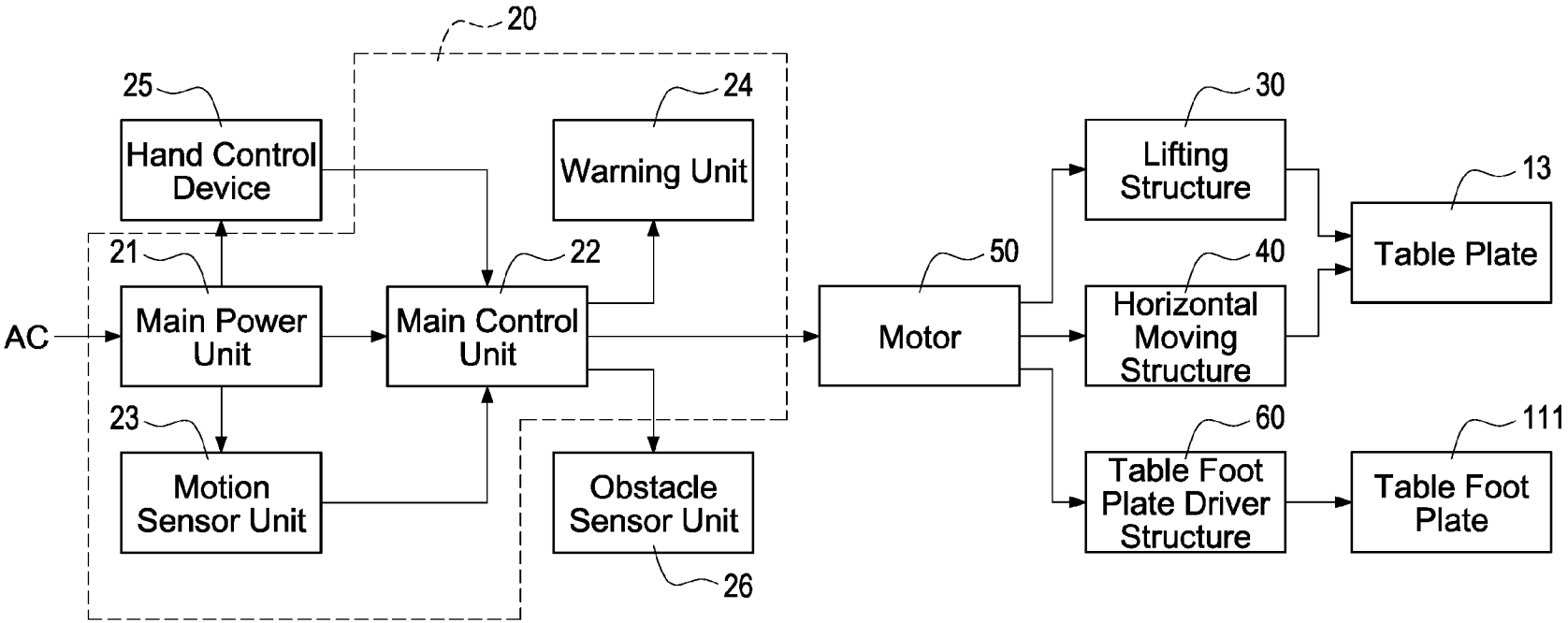
FIG. 4 illustrates a structure diagram of the first embodiment according to the present invention.

Please refer to FIG. 1 to FIG. 4. FIG. 1 is a setting diagram of an electrical adjustable table in a first embodiment according to the present invention. FIG. 2 is a lifting adjusting diagram of an electrical adjustable table of the first embodiment according to the present invention. FIG. 3 illustrates horizontal movement of an electrical adjustable table and motion of a table corner in the first embodiment according to the present invention. FIG. 4 illustrates a structure diagram of the first embodiment according to the present invention.

As illustrated in these drawings, the electrical adjustable table 10 mainly includes multiple table feet 11 with table foot plates 111, a beam 12 between multiple table feet 11, a table plate (table frame) above the beam 12, a control box 20 electrically connected a lifting structure 30 in the multiple table feet 11 and installed above the beam 12, a hand control device 25 disposed at edge of the table plate 13 and electrically connected to the control box 20, an obstacle sensor unit 26 disposed at edge of the table plate 13 and electrically connected to the control box 20, and a horizontal moving structure 40 disposed on the multiple table feet 11 and the beam 12 and electrically connected to the control box 20.

The hand control device 25 is used for receiving an operation and inputting a corresponded operation signal to the control box 20. The control box 20 drives the lifting structure 30 and the horizontal moving structure 40 to make the table plate 13 to arise, lower down or adjusted horizontally according to the operation signal. During adjusting the table plate 13 to arise, to lower down or move horizontally, the control box 20 controls the lifting structure 30 and the horizontal moving structure 40 to avoid hitting both an obstacle below the electrical adjustable table 10 and another obstacle 72 on the electrical adjustable table 10.

The control box 20 may include a main power unit 21, a main control unit 22, a motion (movement) sensor unit 23 and a warning unit 24. The control box 20 is electrically connected to the hand control device 25 and the obstacle sensor unit 26. The main power unit 21 is used for supplying power to the control box 20. In this embodiment, the main power unit 21 may be a rectifying constant voltage circuit connected to external AC power supply to convert an alternative current power source to a stable direct current power output. But, this example should not be regarded as a limitation to the invention scope. The main power unit 21 may also be a battery or a rechargeable battery.

The main control unit 22 is electrically connected to the main power unit 21, the motion sensor unit 23, the warning unit 24 and the hand control device 25. The main control unit 22 controls a motor 50 to drive the lifting structure 30, the horizontal moving structure 40 and a table foot plate driving structure 60. The main control unit 22 may receive a tilt angle sensed by the motion sensor unit 23, may control the warning unit 24 to issue a warning, and may control the lifting structure 30 and the horizontal moving structure 40 to lift or horizontally adjust the table plate 13. Preferably, the main control unit 22 is a micro-processor.

When the electrical adjustable table 10 is started, the main control unit 22 of the control box 20 may initialize an internal setting value or another setting value set by a user to complete initialization setting. In addition, after the electrical adjustable table 10 performs environment detection mode, a static (standby) status is entered.

In the static status of the electrical adjustable table 10, a user may operate the hand control device 25 to make the hand control device 25 to generate and send a corresponded signal to the main control unit 22 so that the main control unit 22 generates a corresponded signal to drive the motor 50 to drive the lifting structure 30 to adjust the height of the table plate 13 to a designated position.

During the lifting of the table plate 13, the main control unit 22 determines the table plate 13 hitting the below obstacle 70 or the above obstacle 72 during lifting if the motion sensor unit 23 detects the tilt angle of the table plate 13 larger or equals to 0.3 degree. Next, the main control unit 22 outputs a signal to drive the warning unit 24 to generate a warning sound and meanwhile stops driving the motor 50 to stop the lifting structure 30 lifting the table plate 13 as illustrated in FIG. 2.

Furthermore, the main control unit 22 outputs a signal to drive the motor 50 to drive the lifting structure 30 to move the table plate 13 to a safety distance in a opposite direction and then to continuously lift in its original direction until the table plate 13 is lifted to the designated position. Preferably, the motion sensor unit 23 is a gyroscope or an accelerometer sensor.

In another embodiment according to the present invention, when the obstacle sensor unit 26 disposed at edge of the table plate 13 detects the obstacle 70 or the obstacle 72, the main control unit 22 controls the lifting structure 30 to enter a safety mode to automatically execute safety mode operation.

Next, a first type of safety mode (safety mode one) is explained. In the safety mode one, when a distance (the first distance) between the obstacle 70 or the obstacle 72 and the table plate 13 is not larger than a first distance setting value, e.g. 10 cm, the main control unit 22 stops adjusting the height of the table plate 13, i.e. to stop the table plate from lifting, and meanwhile, the main control unit 22 drives the warning unit 24 to generate a warning sound.

Next, a second safety mode (safety mode two) is explained. In the safety mode two, when the first distance between the table plate 13 and the obstacle 70 or the obstacle 72 is not less than a second distance predetermined setting value, like 30 cm, the main control unit 22 may drive the lifting structure 30 to keep lifting the table plate 13 to the designated position.

Please be noted that during the aforementioned lifting, when the first distance between the table plate 13 and the obstacle 70 or the obstacle 72 is not larger than the first distance predetermined value (about 10 cm), the main control unit 22 stops adjusting the height of the table plate 13, i.e. executing the safety mode one to stop the table plate 13 from lifting. In addition, the main control unit 22 controls the warning unit 24 to generate warning sound. At this moment, the table plate 13 is in a static status.

A third safety mode (safety mode three) is explained as follows. In the safety mode three, the main control unit 22 may generate a signal to the motor 50 for the motor 50 to immediately switch to the horizontal moving structure 40 to drive the horizontal moving structure 40 to drive the table plate 13 to move horizontally to avoid hitting the obstacle 70 or the obstacle 72. People skilled in this technical field know how to implement the motor 50 switches the driving lifting structure 30, the horizontal moving structure 40 and the table foot driving structure 60 and no further explanation is provided for brevity. Preferably, the obstacle sensor unit 26 is a light sensor unit.

When the table plate 13 of the electrical adjustable table 10 is in a static status and the user puts objects on the table plate 13, the table plate 13 may be tilted due to the weight loading. On the other hand, when an object hits the table plate 13, the table plate 13 may be tilted. To detect the tilt status, the main control unit 22 may use the motion sensor unit 23 to sense a tilt angle of the table plate 13. Besides, the main control unit 22 drives the warning unit 24 to generate a warning if the tilt angle is not smaller than a first angle setting value, e.g. 1 degree, and enters a response mode to automatically execute the response mode operation to keep balance.

Preferably, the main control unit 22 may execute the aforementioned operation only when the tilt angle is not smaller than the first angle setting value and not larger than the second angle setting value, e.g. 10 degrees. For example, the main control unit 22 performs aforementioned operation when the tilt angle is falling between 1 degree to 10 degrees.

Next, a first response mode operation (response mode one) is explained. In the response mode one, the main control unit 22 may drive the motor 50 to drive the table foot plate driving structure 60 to control the table foot plate 111 to extend.

Next, a second response mode operation (response mode two) is explained. In the response mode two, the main control unit 22 may drive the motor 50 to drive the lifting structure 30 to adjust the height of the table plate 13. Preferably, the main control unit 22 lowers the height of the table plate 13 to lower down the gravity center of the electrical adjustable table 10 to prevent to the electrical adjustable table 10 to turn upside down.

Next, a third response operation (response mode three) is explained. In the response mode three, the main control unit 22 may drive the motor 50 to drive the horizontal moving structure 40 to make the table plate 13 to move horizontally to avoid hitting object collision.

Preferably, the hand control device 25 may include a magnet sensor unit (not shown), the magnet sensor unit may use the hand control device 25 to perform wireless charging.

Figure 5:
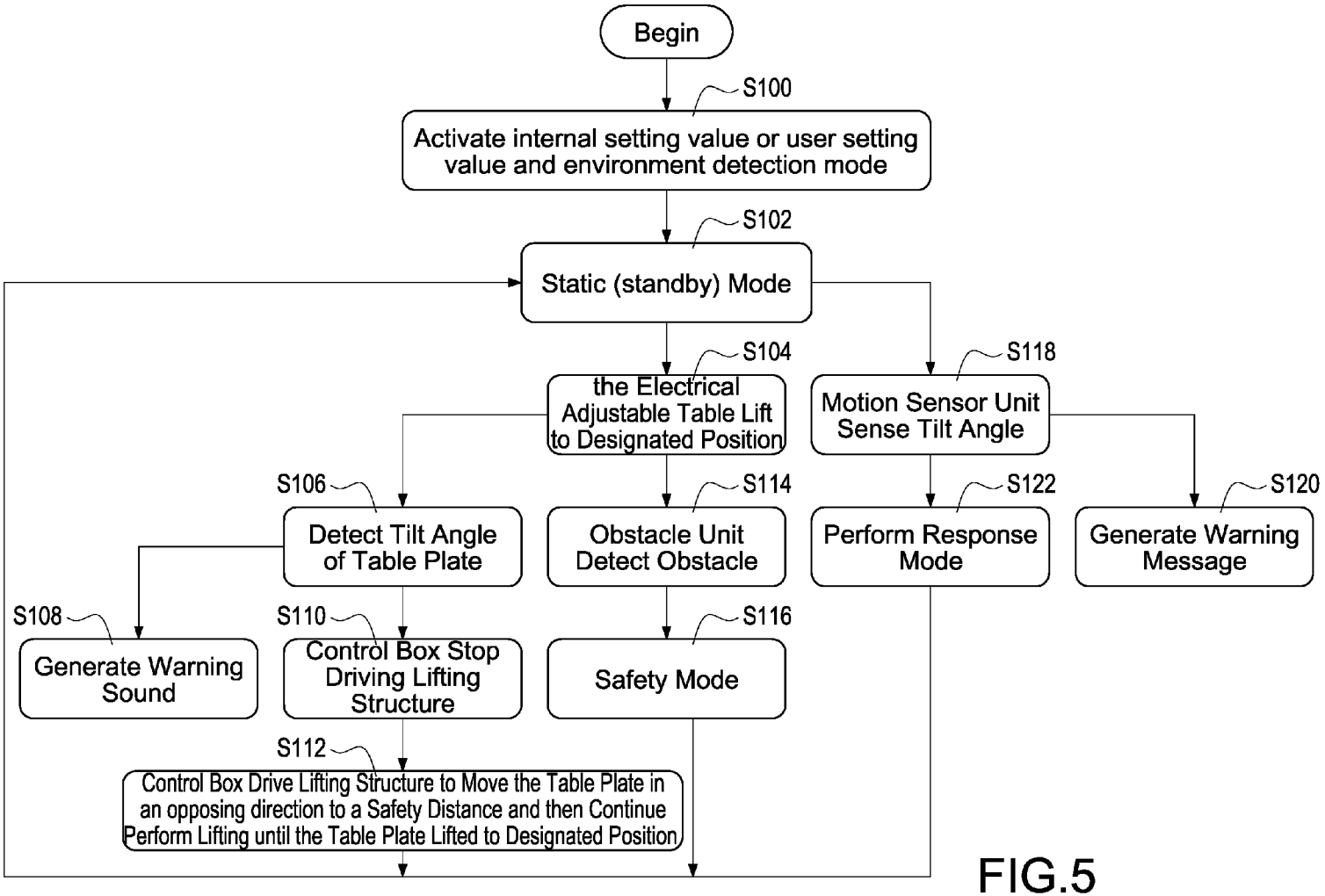
FIG. 5 is a flowchart of a control method of the electrical adjustable table in the first embodiment according to the present invention.

Next, please refer to FIG. 4 and FIG. 5. FIG. 5 is a flowchart of a control method of an electrical adjustable table in the first embodiment according to the present invention.

As illustrated in the drawing, to adjust the height of the electrical adjustable table 10, firstly in step S100, the main control unit 22 in the control box 20 initializes an internal setting value or a user setting value set by a user. Meanwhile, the electrical adjustable table 10 also enters an environment detection mode to detect the obstacles 70, 80.

In step S102, when entering the environment detection mode, the electrical adjustable table 10 enters the static (standby) mode.

In step S104, when the electrical adjustable table 10 is in the static mode, the hand control device 25 may receive the operation of a user to generate and transmit a corresponded signal to the main control unit 22 so that the main control unit 22 outputs a corresponded signal to drive the motor 50 to drive the lifting structure 30 to lift in a first direction to adjust the height of the table plate 13 to the designated position.

In step S106, when the height of the table plate 13 is adjusted, if the main control unit 22 uses the motion sensor unit 23 to sense the tilt angle of the table plate 13 and finds the tilt angle not less than a predetermined angle, like 0.3 degree, the table plate 13 is determined hitting an obstacle, like the below obstacle 70 or the above obstacle 72.

In step S108, if the main control unit 22 uses the motion sensor unit 23 to detect the tilt angle of the table plate 13 and finds the tilt angle not smaller than 0.3 degree, e.g. receiving a corresponded signal at the motion sensor unit 23, the corresponding signal is output to drive the warning unit 24 to generate the warning sound.

In step S110, if the main control unit 22 uses the motion sensor unit 23 to sense the tilt angle of the table plate 13 and finds the tilt angle not smaller than the predetermined angle like 0.3 degree, the motor 50 is stopped to stop driving the lifting structure 30 to stop lifting the table plate 13 as illustrated in FIG. 2.

In step S112, next, the main control unit 22 may immediately output a signal to drive the motor 30 to drive the lifting structure 30 to move the table plate 13 in a second direction opposite to the first direction to a safety distance.

Furthermore, when the table plate 13 is moved to the safety distance, the main control unit 22 may further control the table plate 13 to continuously lift in the first direction until the table plate 13 move to the designated position. Preferably, the motion sensor unit 23 may be a gyroscope or an accelerometer sensor.

In step S114, during adjusting the height of the table plate 13, the main control unit 22 may perform step S116 to enter the safety mode when the main control unit 22 detects the obstacle 70 or the obstacle 80 via the obstacle unit 26 located at edge of the table plate 13.

In step S116, in the safety mode, the main control unit 22 may perform the safety mode one, the obstacle sensor unit 26 is used for sensing the first distance between the table plate 13 and the obstacle 70 or the obstacle 72. If the first distance is found not larger than the first distance predetermined value, e.g. 10 cm, the table plate 13 is forced to stop lifting, e.g. stopping to drive the motor 50. Meanwhile, the warning unit 24 is driven to generate a warning sound.

Alternatively, the main control unit 22 may perform the safety mode two. If the obstacle sensor unit 26 is used for finding that the first distance between the table plate 13 and the obstacle 70 or the obstacle 72 not less than the second distance predetermined setting value, e.g. 30 cm, the table plate 13 is continuously lifted to the designated position.

In the safety mode two, if the main control unit 22 finds the first distance not larger than the first distance setting value like 10 cm via the obstacle sensor unit 26 when the safety mode one and the safety mode two may be performed at the same time, the main control unit 22 stops the table plate 13 to continuously lift when the table plate 13 is at static mode and the warning unit 24 generates a sound.

Alternatively, the main control unit 22 may perform the safety mode three, the main control unit 22 outputs the corresponded signal to the motor 50 so that the motor 50 is immediately switched to drive the horizontal moving structure 40 and the table plate 13 is driven by the horizontal moving structure 40 to move horizontally to avoid hitting the obstacle 70 or the obstacle 72.

In step S118, when the table plate 13 is at the static mode, the main control unit 22 may use the motion sensor unit 23 to sense the tilt angle of the table plate 13 to determine whether the table plate 13 is tilted. Preferably, the main control unit 22 determines the table plate 13 tilted when the tilt angle is not smaller than the first angle setting value like 1 degree.

In step S120, the main control unit 22 drives the warning unit 24 to generate a warning.

In step S122, the main control unit 22 enters the response mode to automatically perform response mode operation like the response mode one, the response mode two, or the response mode three as mentioned above to keep balance.

Figure 6:
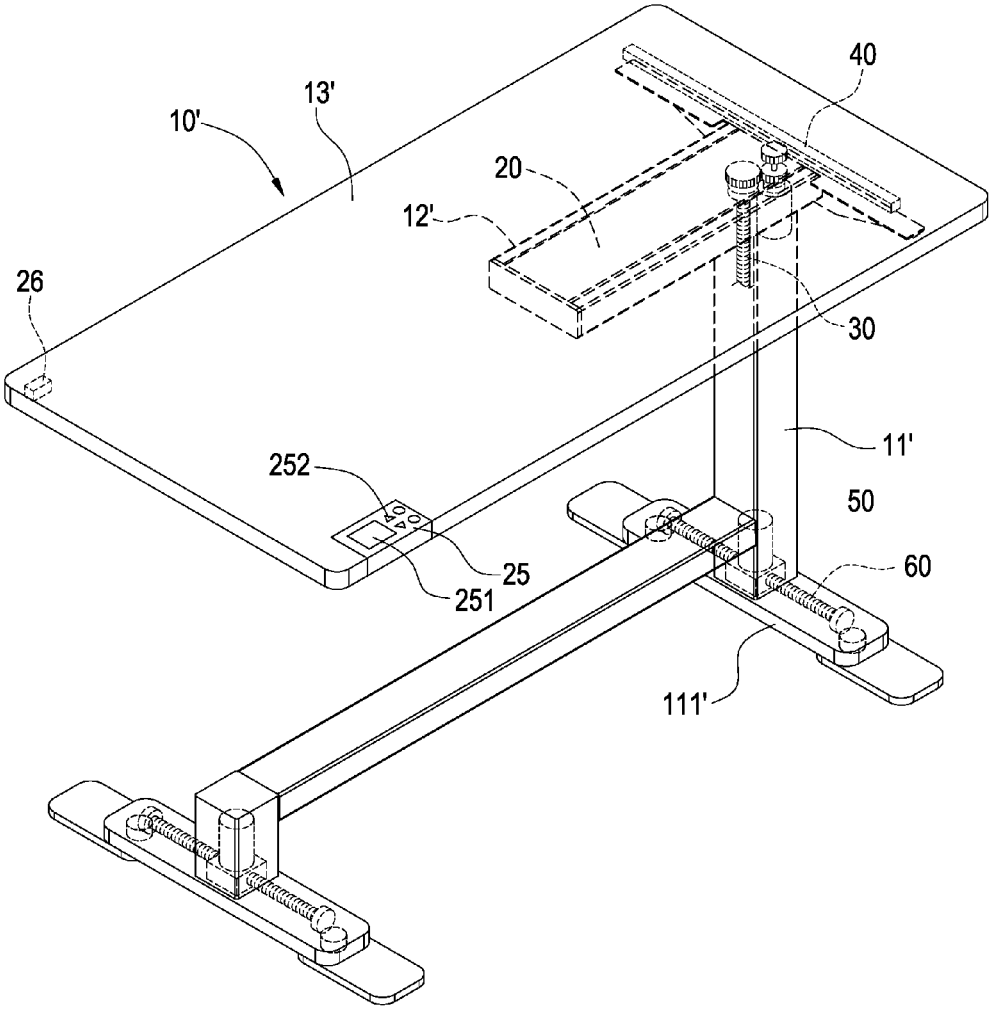
FIG. 6 is a diagram of an electrical adjustable table in a second embodiment according to the present invention.

Please refer to FIG. 6, which is a diagram of an electrical adjustable table of a second embodiment according to the present invention. As illustrated in the drawing, the electrical adjustable table 10' includes a single table foot 11'. The table foot 11' has a table foot plate 111'. The table foot 11' has a beam 12'. A table plate 13' is disposed on the beam 12' and the table foot 11'. The control box 20 may be disposed in the beam 12'. The beam 12' and the table foot 11' are embedded with a lifting structure 30 and the control box 20 may also embedded together with the lifting structure 30 in the table foot 11'. The table plate 13' is disposed with the motion sensor unit 23. The motion sensor unit 23 may be disposed in the control box 20 or the hand control device 25. The hand control device 25 has at least one touch screen 251 or a button 252. The hand control device 25 may be embedded to the table plate 13'. Besides, the hand control device 25 and the table plate 13' are at the same height, i.e. the hand control device 25 and the table plate 13' having substantially equal thickness. The hand control device 25 and the control box 20 may further be implemented as unibody design (not shown).

Figure 7:
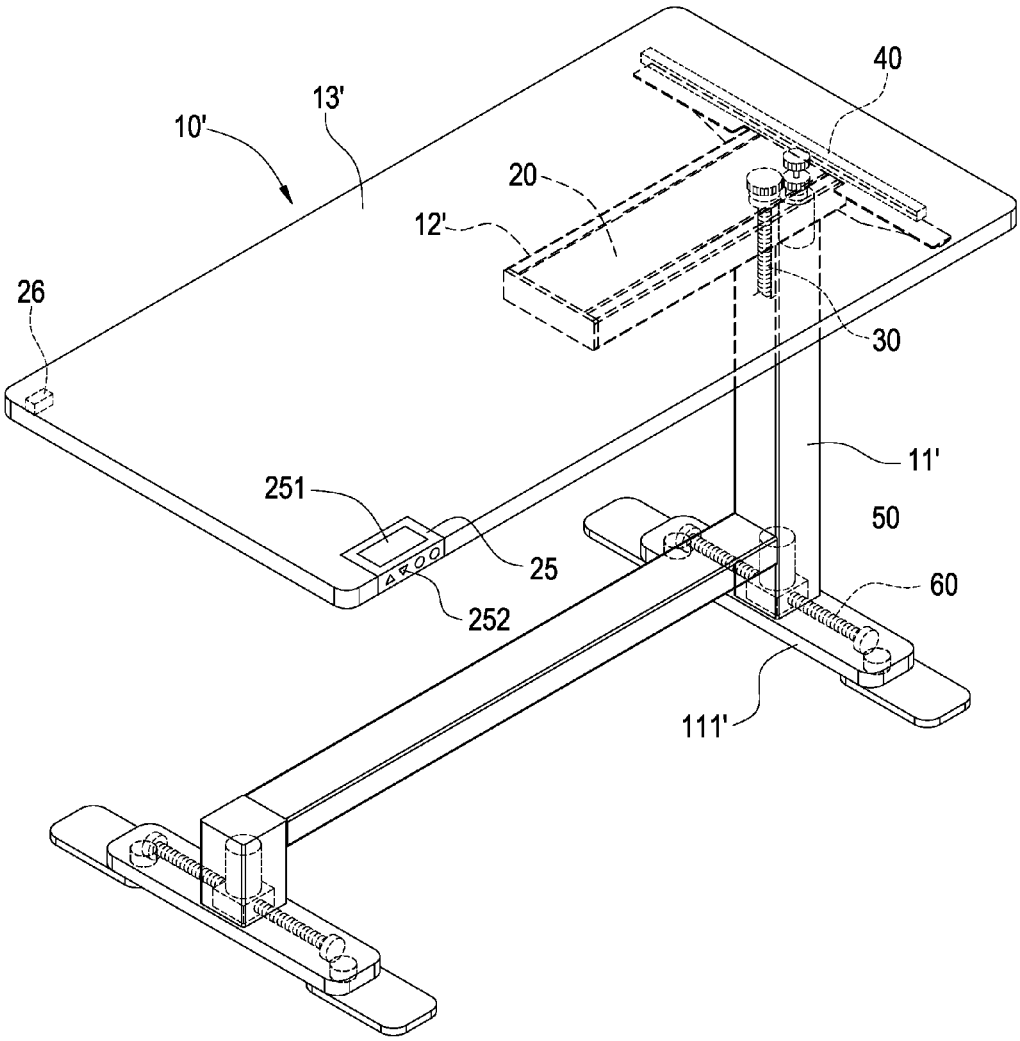
FIG. 7 is a diagram of an electrical adjustable table in a third embodiment according to the present invention.

Please refer to FIG. 7, which is a diagram of an electrical adjustable table in a third embodiment according to the present invention. In the embodiment, the touch screen 251 and the button 252 are located at different lateral sides of the hand control device 25. Furthermore, for satisfying ergonomics and user habit, the touch screen 251 and the button 252 may be disposed at the top surface of the hand control device 25 and an adjacent surface that is adjacent to the top surface.

In the embodiment, the lifting, horizontal movement and control of table foot plate of the electrical adjustable table 10' are the same as aforementioned embodiment. When the electrical adjustable table 10' is started, the internal setting value or the user setting value are initialized, an environment detection is performed, and the static mode is entered. When the electrical adjustable table 10' is at static mode, the hand control device 25 may a corresponded signal to the control box 20 according to user operation so that the control box 20 drives the lifting structure 30 to adjust the height of the table plate 13' to the designated position. During lifting the table plate 13', the motion sensor unit 23 detects whether the table plate 13' is tilted. If the tilt is detected, the lifting structure 30 stops driving the table plate 13' to lift.

During the lifting of the table plate 13', when the obstacle sensor unit 26 on the table plate 13' detects the obstacle (not shown), the control box 20 switches the lifting mechanism to the safety mode to perform the safety mode operation.

When the table plate 13' is at static mode, if the motion sensor unit 23 detects the table plate 13' tilted, the main control unit 22 immediately drives the warning unit 24 to generate a warning and enters the response mode to perform response mode operation.

Figure 8:
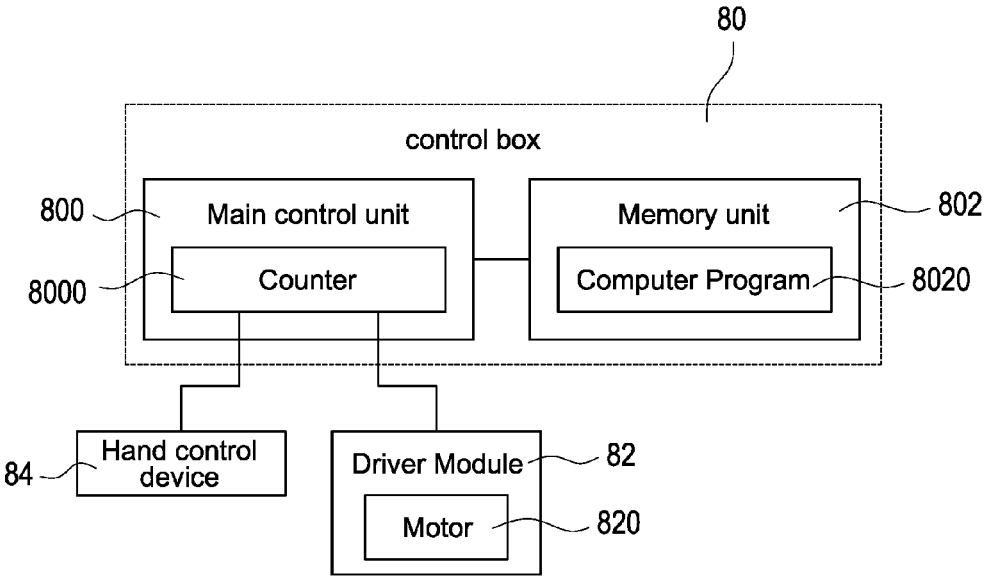
FIG. 8 is a structure diagram of a control box in a fourth embodiment according to the present invention.
Figure 9A:
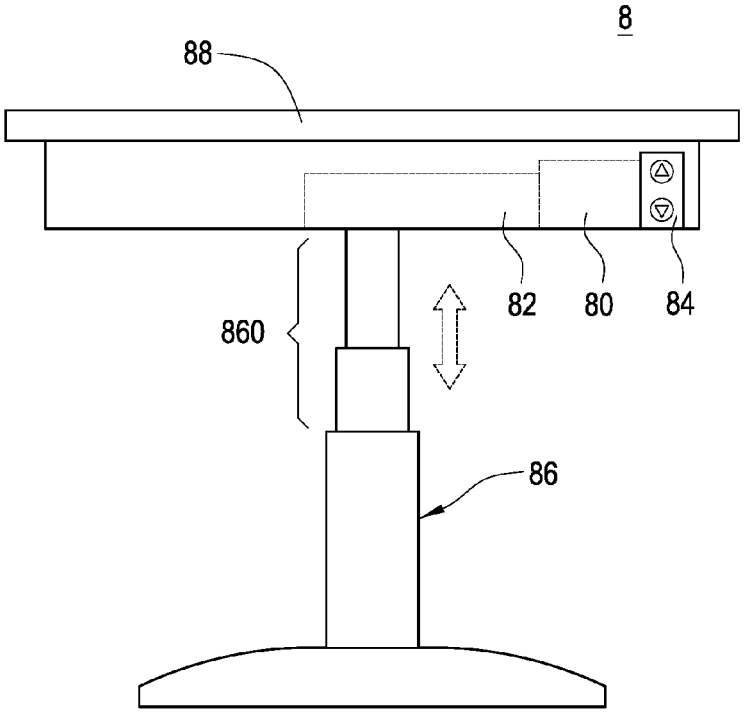
FIG. 9A is a diagram of an electrical adjustable table in the fourth embodiment according to the present invention.

Please refer to FIG. 8 and FIG. 9A. FIG. 8 is a control box structure diagram in the fourth embodiment according to the present invention. FIG. 9A is an electrical adjustable table diagram in the fourth embodiment according to the present invention to explain an electrical adjustable table structure with constant speed lifting.

In current electrical adjustable tables, motors are operated in constant speed, i.e. a fixed power being provided. Therefore, if the weight loading on the electrical adjustable table is increased, e.g. a heavier object being placed over the table plate, the extending or shrinking speed of the table foot is slowed down. When the weight loading on the electrical adjustable table is decreased, e.g. a lighter object being placed over the table plate, the extending or shrinking speed of the table foot is increased. This causes the problem that the table foot is not extended or shrunk with a constant speed.

As illustrated in the drawings, the invention further discloses an electrical adjustable table 8 that can solve the aforementioned problem. The electrical adjustable table 8 includes a control box 80, at least one driver module 82, a hand control device 84 and at least one table foot 86. The table foot 86 is connected to a table plate 88 of the electrical adjustable table 8 for supporting the table plate 88 and may be extended or shrunk driven by the driver module 82.

Please be noted that the electrical adjustable table 8 is similar to the electrical adjustable table 10 in the first embodiment, i.e. having the same or similar components and structures. For brevity, FIG. 8 only shows main difference of the electrical adjustable table 8 compared with the electrical adjustable table 10.

The driver module 82 may adjust the length of the table foot 86. Specifically, the driver module 82 may include a motor 820. The table foot 86 includes an extending or shrinking structure 860 connected to the motor 820 and controlled by the motor 820. When the motor 820 is operated, multiple driver components like gears (not shown) are driven so that the extending or shrinking structure 860 like a lever structure is extended (to increase the length of the table foot 86 so that the height of table plate 88 of the electrical adjustable table is increased) or shortened (to decrease the length of the table foot 86 so that the height of the table plate 88 of the electrical adjustable table 8 is lowered down).

Please be noted that the assembly of the driver module 82, including the motor 820, and the extending or shrinking structure 860 correspond to the assembly of the motor 30 and the lifting structure 30. Both structures may adjust the height of the table plate 13, 88 by extending or shrinking the table feet 11, 86.

The hand control device 84 is a human-machine interface like a touch screen or a button for receiving user operation. The hand control device 84 also generates and transmits a table foot control signal to the control box 80 according to the user operation.

In the embodiment, the control box 80 mainly include a main control unit 800 and a memory unit 802 electrically connected to the main control unit 800. The main control unit 800 is electrically connected to the driver module 82 and the hand control device 84. The hand control device 84 receives the table foot control signal and controls the driver module 82 according to the table foot control signal to adjust the length of the table foot 86. The memory unit 802 is used for storing data.

In this embodiment, the electrical adjustable table 1 includes a set of the table foot 86, but this configuration is only an example. The number of the table feet 86 may be modified under different design requirements.

Figure 9B:
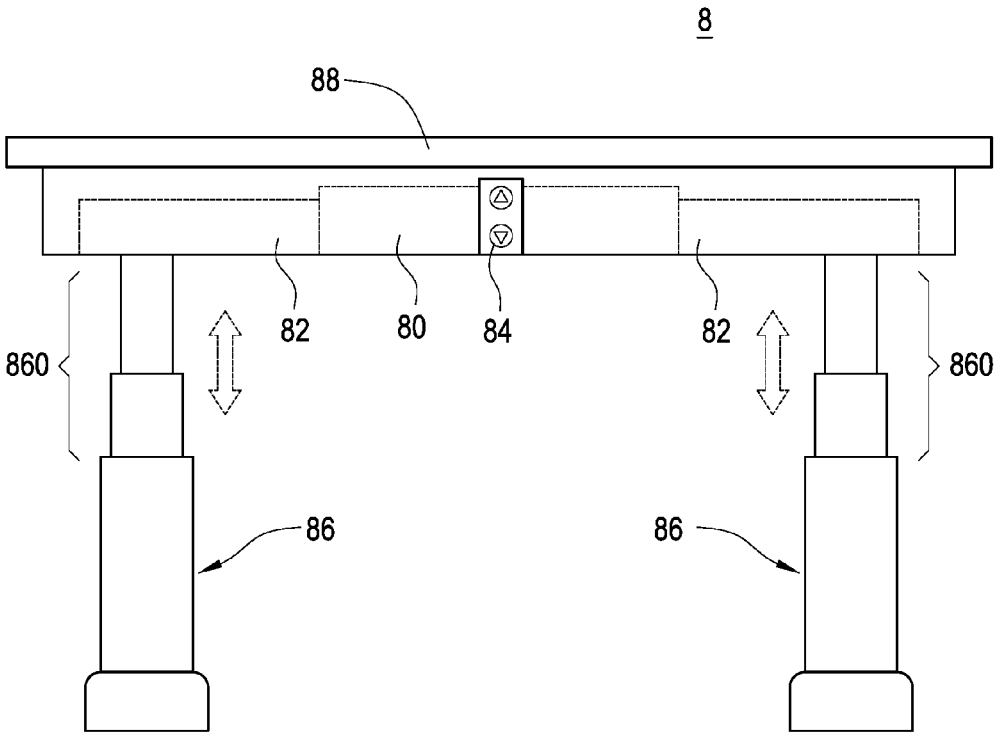
FIG. 9B is a diagram of an electrical adjustable table in a fifth embodiment according to the present invention.

Please refer to FIG. 9B, which illustrates an electrical adjustable table and explains how the constant speed lifting may be applied on the electrical adjustable table 8 having multiple table feet.

The difference between this embodiment and the fourth embodiment includes that the electrical adjustable table 1 has two set of the table feet 86 and two driver modules 82 respectively connected to the two sets of the table feet 86. The control box 80 may control the motor 820 of each driver module 82 to operates at the same time so that the two extending or shrinking structures 860 of the two table feet 86 to extend or to shrink at the same time.

Please be noted that the control method of the electrical adjustable table is applied in the control box 80 in FIG. 8. Specifically, the memory unit 802 may store a computer program 8020 that include program codes operated by the main control unit 800. When the main control unit 800 executes the computer program 8020, the steps of the control method of the electrical adjustable table are performed.

Figure 10:
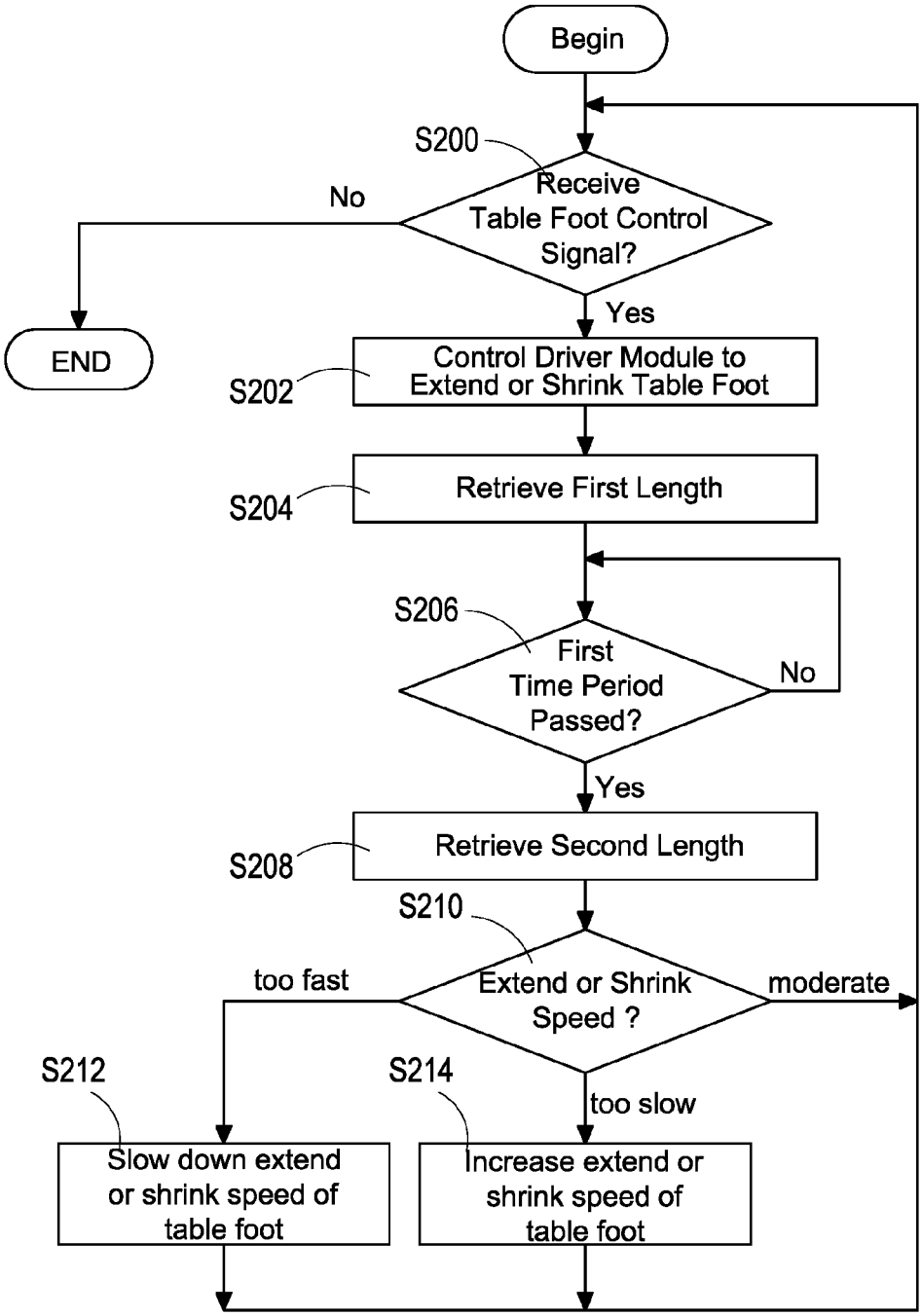
FIG. 10 is a partial flowchart of a control method of the electrical adjustable table in the second embodiment according to the present invention.

Please refer to FIG. 10, which is a partial flowchart of a control method of the electrical adjustable table in the second embodiment according to the present invention. The control method of the electrical adjustable table include following steps that provide constant extending or shrinking speed.

In step S200, the control box 80 detects whether the table foot control signal is received. Specifically, the control box 80 may detect whether the table foot control signal (i.e. whether the user performs controlling via the hand control device 84 or the external device) is received from the hand control device 84 or an external device (e.g. an external mobile device connected via a network). If the control box 80 receives the table control signal, the step S202 is performed. Otherwise, the control method of the electrical adjustable table is ended.

In step S202, the driver module 82 is controlled to extend or shrink the table foot 86. Specifically, the control box 80 generates and transmits a motor control signal to the driver module 82 according to the received table foot control signal to control the operation of the motor 820, e.g. to control the rotation direction or rotation speed of the motor 820 to adjust the height of the table plate 88 by adjusting the length of the table foot 86 with the motor 820.

In step S204, a first length is retrieved. Specifically, during the extending or shrinking of the table foot 86, the control box 80 may use a sensor disposed in the driver module 82 or the extending or shrinking structure 860 (like a speed sensor or a shifting sensor not shown) to retrieve the current first length of the table foot 86.

Preferably, the sensor is a hall effect sensor. The control box 80 uses the hall effect sensor to detect the current length of the table foot, i.e. the first length. Specifically, the control box 80 uses the hall effect sensor to sense a hall effect signal value, i.e. the first hall effect signal value, corresponding to the first length.

Please be noted that the hall effect signal value is proportional to the current length of the table foot 86. In other words, if the table foot 86 has a longer length, the more hall effect signal value is sensed. If the length of the table foot 86 is shorter, the hall effect signal is less. But, this is not to limit the invention scope.

In another embodiment, the hall signal value is inversely proportional to the current length of the table foot 86. In other words, if the length of the table foot 86 is longer, the sensed hall signal value is less. If the length of the table foot 86 is shorter, the sensed hall signal value is more.

In step S206, the control box 80 counts whether a first time period is passed. If the first time period is passed, the step S208 is performed. Otherwise, the step S206 is repeated to continuously the time counting.

In step S208, the control box 80 retrieves a current second length of the table foot 86.

Preferably, the control box 80 uses the hall effect sensor to sense another hall effect signal value (i.e. a second hall effect signal value) of the second length (the length of the table foot 86 after the first time period).

In step S210, the control box 80 determines whether a current extending or shrinking speed is too fast, too slow or moderate according to the first length and the second length. If the extending or shrinking speed is too fast, step S212 is performed to slow down the speed. If the extending or shrinking speed is too slow, step S214 is performed to speed up. If the extending or shrinking speed is moderate, the current extending or shrinking speed of the table foot 86 is not adjusted and step S200 is performed to continuously detect the table foot control signal.

Preferably, the control box 80 is used for calculating a signal value difference between the first hall effect signal value and the second hall effect signal value (i.e. the signal value difference corresponding to an extending or shrinking length of the table foot 86 within a first time period) and determines whether the signal value difference is larger than a predetermined first signal threshold (like 3). If the signal value difference is larger than a predetermined first signal threshold value, i.e. the extending or shrinking length of the table foot 86 in the first time period being larger than an extending or shrinking threshold value, the current extending or shrinking speed is determined too fast.

The control box 80 may further determine whether the signal value difference is smaller than a predetermined second signal threshold (like 1), where the second signal threshold is not larger than the first signal threshold value. If the signal value difference is smaller than the second signal threshold value, the current extending or shrinking speed is determined too slow.

If the control box 80 determines that the signal value difference is not larger than the first signal threshold value and not smaller than the second signal threshold value, the current extending or shrinking speed is determined moderate and no need to be adjusted.

Preferably, the first signal threshold value is equal to the second signal threshold value, e.g. both as 2. In such case, the extending or shrinking speed is determined moderate when the signal value difference is equal to the first signal threshold value and the second signal threshold value.

In step S212, the control box 80 controls the driver module 82 to slow down the extending or shrinking speed of the table foot 86 so that the table foot 86 is extended or shrunk at constant speed. Next, step S200 is performed to continuously detect the table foot control signal.

In step S214, the control box 80 controls the driver module 82 to increase the extending or shrinking speed of the table foot 86 so that the table foot 86 is extended or shrunk at constant speed. Next, step S200 is performed to continuously detect the table foot control signal.

Please be noted that step S200 and S202 in the embodiment are similar to the step S104 in FIG. 5. In other words, after the step S104 in FIG. 5, step S204 of this embodiment is performed. In other words, steps S106-S112, S114-S116 in FIG. 5 and steps S204-S214 are performed in parallel. By such, the control method of the electrical adjustable table may perform table plate tilt detection function, obstacle detection function and constant speed lifting function at the same time during lifting of the table plate.

Figure 11A:
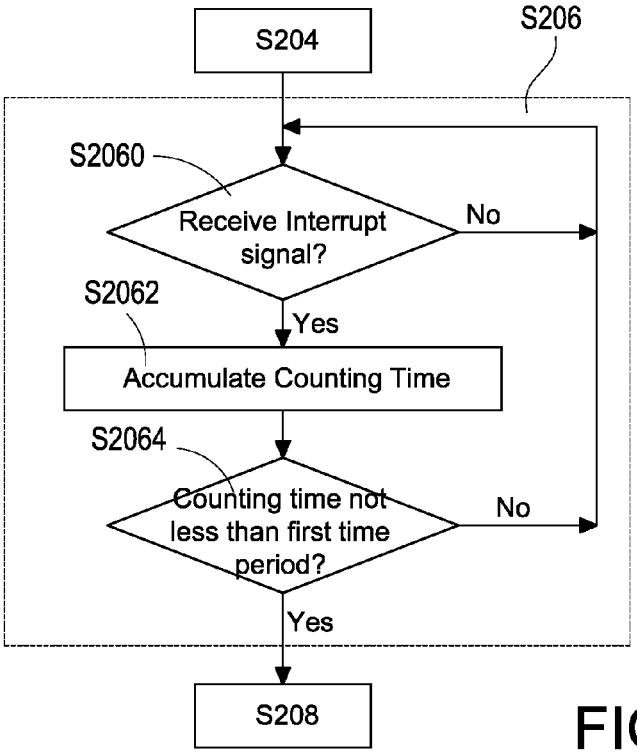
FIG. 11A is a partial flowchart of a control method of the electrical adjustable table in the third embodiment according to the present invention.

Next, please refer to FIG. 8, FIG. 9A, FIG. 9B, FIG. 10 and FIG. 11A. FIG. 11A is a partial flowchart of a control method of an electrical adjustable table in the third embodiment. Step S206 in FIG. 10 in explained in more detail in this embodiment and may include following steps specifically.

In step S2060, the control box 80 determines whether an interrupt signal is received. Specifically, the main control unit 800 of the control box 80 includes a counter 8000. The counter 8000 sends an interrupt signal for every interrupt period like 333 μs.

In step S2062, the control box 80 accumulates a counting time. Specifically, the control box 80 accumulates one interrupt time each time when receiving one interrupt signal.

For example, when the interrupt signal is 333 μs, when one interrupt signal is received, the accumulated time is 333 μs. When two interrupt signals are received, the accumulated time is 666 μs. When the third interrupt signal is received, the accumulated signal is 999 μs (about 1 ms). As such, the control box may use the interrupt signals to count time.

In step S2064, the control box 80 determines whether the counted time is not less than the first time period. If the counted time is not less than the first time period, step S208 is performed. Otherwise, step S2060 is performed to continuously detect the interrupt signal.

Figure 11B:
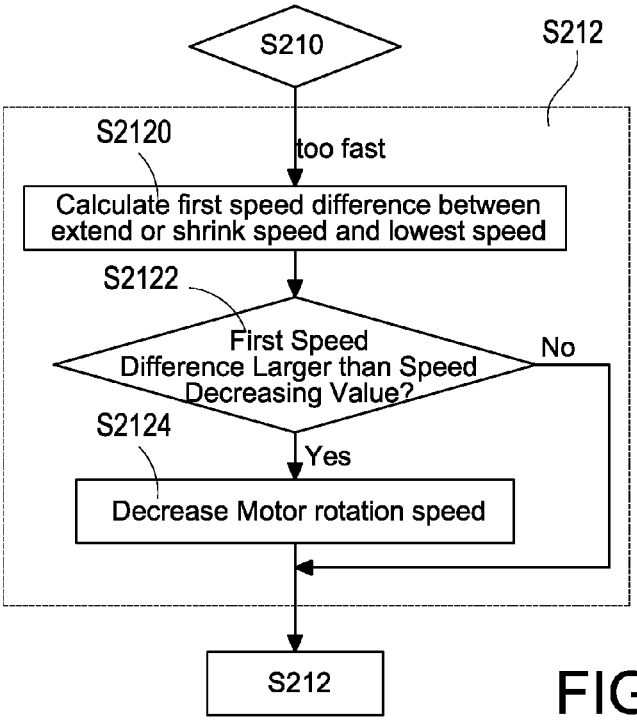
FIG. 11B is a partial flowchart of a control method of the electrical adjustable table in the fourth embodiment according to the present invention.

Please refer to FIG. 8, FIG. 9A, FIG. 10 and FIG. 11B. FIG. 11B is a partial flowchart of a control method of an electrical adjustable table in the fourth embodiment according to the present invention. Step S212 in FIG. 10 in the embodiment is explained in more details as follows and may specifically include following steps.

In step S2120, the control box 80 calculates a first speed difference value between the current extending or shrinking speed and a lowest speed.

In step S2122, the control box 80 determines whether the first speed difference value is larger than a speed decreasing value. Specifically, the speed decreasing value is the smallest speed value to decrease the extending or shrinking speed after the slow down control is performed by the control box 80. If the first speed difference value is larger than the speed decreasing value, it may be predicted that after the slowing down is performed, the extending or shrinking speed is not too slow, overflow or turning to zero (i.e. stopped) and step S2124 is performed. Otherwise, the control box 80 predicts that after slowing down is performed, the extending or shrinking speed may be too slow, overflow or turning to zero without performing slow down operation.

In step S2124, the control box 80 controls the driver module 82 to slow down the rotation speed of the motor 820. Specifically, the control box 80 controls the driver module 82 to decrease a pulse width modulation (PWM) value of the motor 820 to decrease the voltage value of the motor 820 to decrease the rotation speed of the motor 820.

Figure 11C:
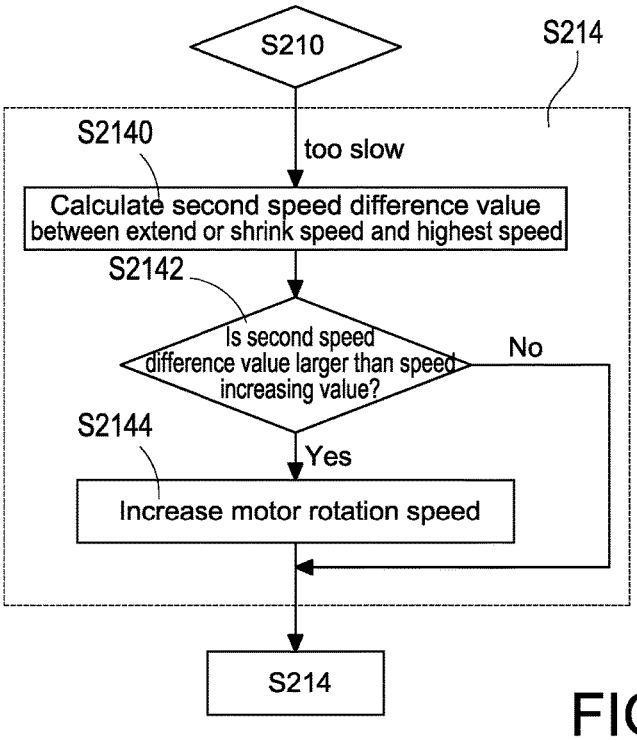
FIG. 11C is a partial flowchart of a control method of the electrical adjustable table in the fifth embodiment according to the present invention.

Please refer to FIG. 8, FIG. 9A, FIG. 9B, FIG. 10 and FIG. 11C. FIG. 11C is a partial flowchart of a control method of the electrical adjustable table in the fifth embodiment. Step S214 in FIG. 10 in this embodiment is explained in more details as follows.

In step S2140, the control box 80 calculates a second speed difference value between the current extending or shrinking speed and a fastest speed.

In step S2142, the control box 80 determines whether the second speed difference value is larger than a speed increasing value. Specifically, the speed increasing value is the smallest speed value to increase the extending or shrinking speed after speeding up control by the control box 80. If the second speed difference value is larger than the speed increasing value, the control box 80 may predicate after the speeding up control, the extending or shrinking speed may not be too fast or overflow, and step S2124 is performed. Otherwise, the control box 80 predicts after the speeding up operation, the extending or shrinking speed may be too fast or overflow and speeding-up operation is not performed.

In step S2144, the control box 80 controls the driver module 82 to increase the rotation speed of the motor 820. Specifically, the control box 80 controls the driver module 82 to increase the pulse width modulation value of the motor 820 to increase the voltage of the motor 820 to increase the rotation speed of the motor 820.

Figure 12:
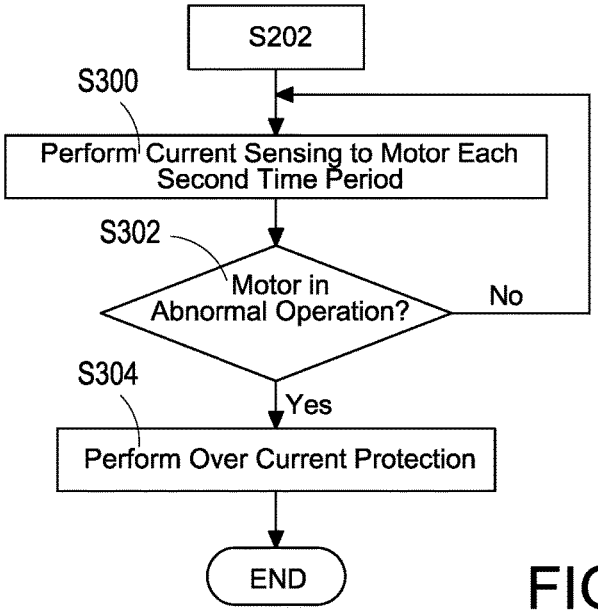
FIG. 12 is a partial flowchart of a control method of the electrical adjustable table in the sixth embodiment according to the present invention.

Please refer to FIG. 8, FIG. 9A, FIG. 9B, FIG. 10 and FIG. 12. FIG. 12 is a partial flowchart of a control method of an electrical adjustable table in the sixth embodiment. The difference between the embodiment and the second embodiment in FIG. 10 includes following steps for performing over current protection after step S202 in this embodiment.

In step S300, the control box 80 performs current sensing every second time period, like 100 ms, on the motor to retrieve current values of the motor 820 at different timing points.

In step S302, the control box 80 determines whether the motor 820 is abnormal according to multiple retrieved current values. If the motor 820 is determined abnormal, step S304 is performed. Otherwise, step S300 is performed to continue the sensing.

In step S304, the control box 80 performs an over current protection mechanism to prevent the motor 820 being damaged due to over loading of current. Preferably, the over current protection mechanism is to control the driver module 82 to stop extending or shrinking the table foot 86, i.e. to stop operation of the motor 820, and heading the opposite direction to extend or shrink the table foot after being stopped, i.e. the motor is operated in opposite direction).

By such, the present invention may effectively prevent the table plate 88 of the electrical adjustable table 8 hitting an obstacle like too heavy weight loading or stuck by obstacles like a closet or a stool during rising up or lowering down so as to avoid over current loading and getting burnt due to continuous high rotation speed.

Figure 13A:
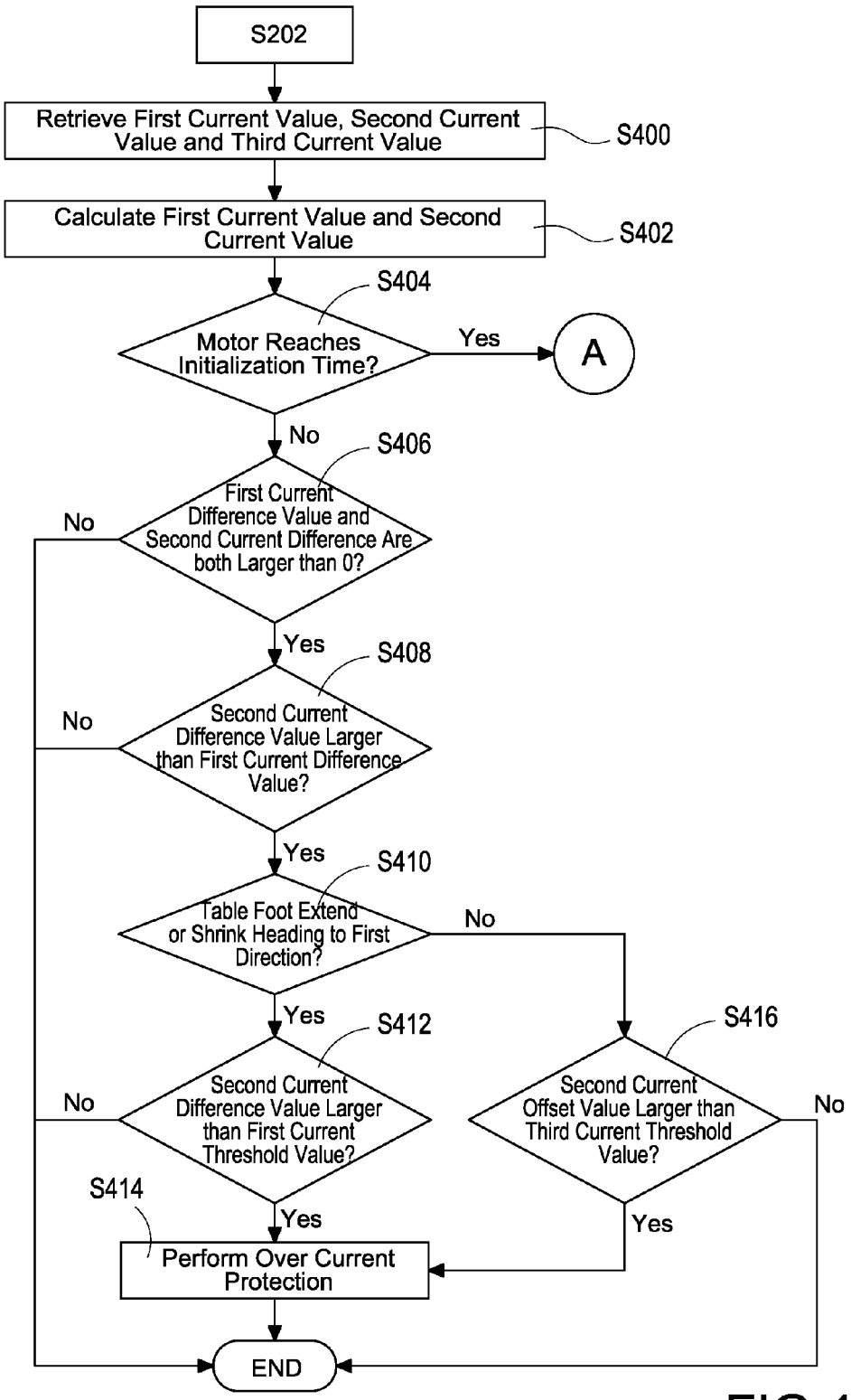
FIG. 13A is a first partial flowchart of a control method of the electrical adjustable table in the seventh embodiment according to the present invention.
Figure 13B:
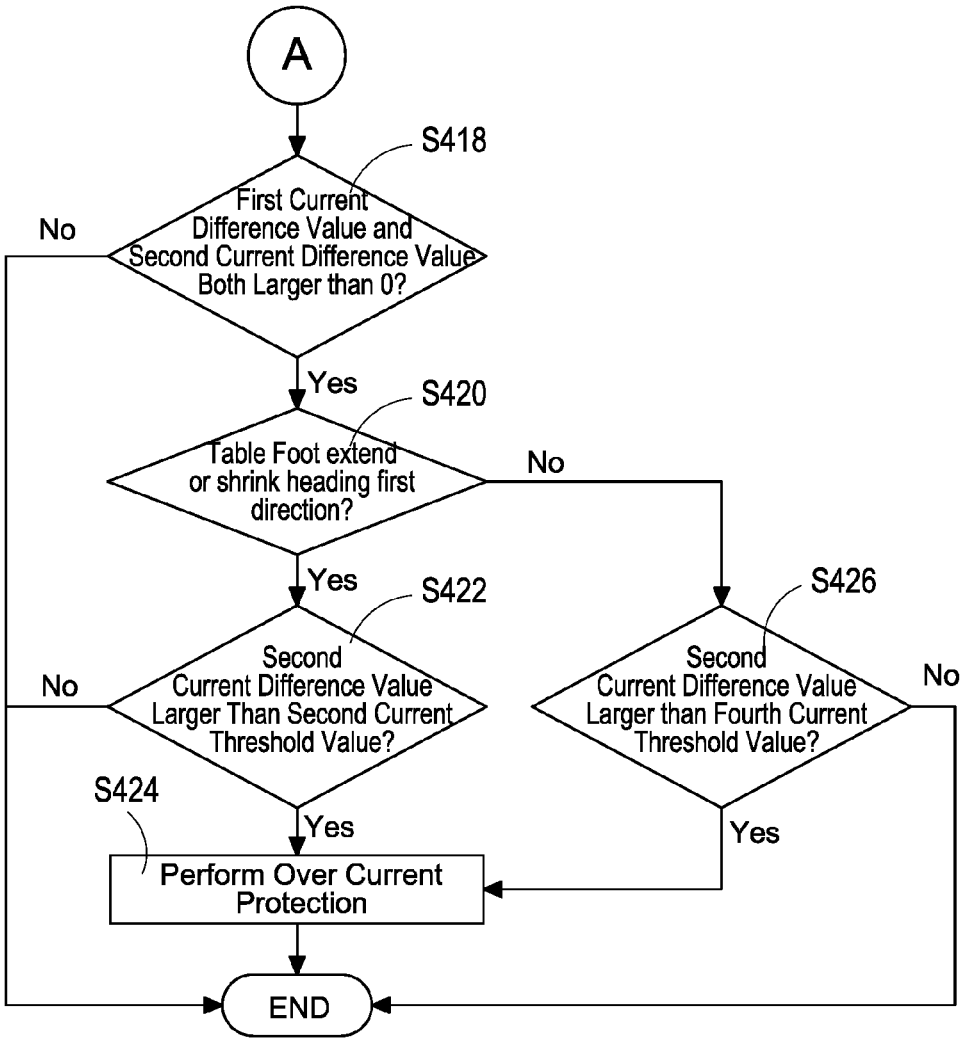
FIG. 13B is a second partial flowchart of a control method of the electrical adjustable table in the seventh embodiment according to the present invention.

Please refer to FIG. 8, FIG. 9A, FIG. 9B, FIG. 10, FIG. 13A and FIG. 13B. FIG. 13A is a first partial flowchart of a control method of an electrical adjustable table in the seventh embodiment. FIG. 13B is a second partial flowchart of a control method of an electrical adjustable table in the seventh embodiment. The difference between this embodiment and the second embodiment in FIG. 10 includes following steps of over current protection.

In step S400, the control box 80 performs current sensing on the motor 820 each second time period to sequentially retrieve at least three current values, like a first current value, a second current value and a third current value.

In step S402, the control box 80 calculates a first current difference value between the first current value and the second current value and also calculates a second current difference value between the second current value and the third current value.

In step S404, the control box 80 determines whether the motor 820 has started reaching an initialization time. If the motor 820 has not started reaching the initialization time, step S406 is performed to determine whether the motor 820 is abnormal according to a first determination mechanism. If the motor 820 has started reaching the initialization time, step S418 is performed to determine whether the motor 820 is abnormal according to a second determination mechanism.

Please be noted that when the motor 820 has started, e.g. the first three seconds after starting, the current value of the motor 820 is very unstable and has large variance. In this embodiment, the first determination mechanism is used for determining whether the motor 820 is abnormal. When the motor 820 is operated stably, e.g. after three seconds of starting, the current value of the motor 820 approaches to a stable fixed value. Therefore, the embodiment is changed for using the second determination mechanism to determine whether the motor 820 is abnormal.

By such, the present invention uses different determination mechanisms to separately monitor current when the motor 820 is started and when the motor 820 is operated stably to effectively increase reliability of monitor result.

Next, the first determination mechanism is explained.

In step S406, the control box 80 determines whether the first current difference value and the second current difference value are both larger than zero. If both are larger than zero, it means that the current of the motor 820 is in increasing trend. Step S408 is performed next to perform further determination. Otherwise, the motor 820 is determined being operated normally and the first determination mechanism is ended.

In step S408, the control box 80 determines whether the second current difference value is much larger than the first current difference value. Preferably, the control box 80 determines whether the second current difference value is not smaller than four times of the first current difference value. If the second current difference value is much larger than the first current difference value, step S410 is performed to perform further determination. Otherwise, the motor 820 is determined being operated normally and the first determination mechanism is ended.

Specifically, because the motor 820 is less stable when it is just started, the first determination mechanism in the present invention increases determination threshold by determining the motor 820 abnormal only when the current value increases dramatically, e.g. the current value increasing more than four times to decrease the chance of mistaken determination of abnormal operation of the motor 820.

In step S410, the control box 80 determines whether the table foot 86 is extended or shrunk in a first direction. If the table foot 86 is extended or shrunk in the first direction, e.g. the table foot 86 extending outwardly to increase its length, step S412 is performed to use a first current threshold value like 800 mA for performing further determination. If the table foot 86 is extended or shrunk in an opposite second direction, e.g. the table foot 86 shrinking inwardly to decrease its length, step S416 is performed by using a different third current threshold value like 400 mA for performing further determination.

Please be noted that the motor 820 has different current values when rotating in positive direction and in inverse direction respectively. In the same rotation speed, the current value of the motor 820 rotated in positive direction has larger current value than the current value of the motor 820 rotated in inverse direction. It is also possible that the current value of the motor 820 rotated in inverse direction is larger than the current value of the motor 820 rotated in positive direction.

In the present invention, different threshold values are applied for performing over current determination for different rotation direction of the motor, i.e. the extending or shrinking direction of the table foot, to effectively increase accuracy of determination.

In step S412, the control box 80 determines whether the second current difference value is larger than a first current threshold value corresponding to a first direction. If the second current difference value is larger than the first current threshold value, the motor 820 is determined operated abnormally and next, step S414 is performed. Otherwise, the motor 820 is operated normally.

In step S414, the control box 80 performs the over current protection mechanism. The over current protection mechanism is the same as the one in step S304 in aforementioned embodiment and not repeated here for brevity.

In step S416, the control box 80 determines whether the second current difference value is larger than the third current threshold value corresponding to the second direction. In this embodiment, the third current threshold value is smaller than the first current threshold value but it is not limitation to invention scope. If the second current difference value is larger than the third current threshold value, the motor 820 is determined being operated abnormally, and next step S414 is performed. Otherwise, the motor 820 is determined being operated normally.

If in step S404, the motor 820 is determined reaching the initialization time, i.e. the motor being operated stably, the second determination mechanism is performed, i.e. steps S418-S426 in FIG. 6B.

Next, the second determination mechanism is explained.

In step S418, the control box 80 determines that whether the first current difference value and the second current difference value are both larger than zero. If they are both larger than zero, step S420 is further performed for determination. Otherwise, the motor 820 is determined being operated normally to end the second determination mechanism.

In step S420, the control box 80 determines whether the table foot 86 is extending or shrinking heading the first direction. If the table foot 86 is extending or shrinking heading the first direction, step S422 is performed to use a second current threshold value, e.g. 600 mA to perform further determination. If the table foot 86 is extended or shrunk in an opposite second direction, step S426 is performed to use a different fourth current threshold value like 300 mA to perform further determination.

In step S422, the control box 80 determines whether the second current difference value is larger than the second current threshold value corresponding to the first direction. If the second current difference value is larger than the first current threshold value, the motor 820 is determined being operated abnormally, and then, step S424 is performed. Otherwise, the motor 820 is determined being operated normally.

Preferably, because the motor 820 is in stable operation status, i.e. the current value of the motor 820 is smaller and more stable, the present invention further set the second current threshold value like 600 mA to be smaller than the first current threshold value like 800 ma in initialization status to increase accuracy of determination.

In step S424, the control box 80 performs the over current protection mechanism. In this embodiment, the over current protection mechanism is the same as the embodiment in step S304 and not explained again for brevity.

In step S426, the control box 80 determines whether the second current difference value is larger than the fourth current threshold value corresponding to the second direction. In this embodiment, the fourth current threshold value like 300 mA is smaller than the first current threshold value like 800 mA and the second current threshold value like 600 mA, but such setting should be regarded as limitation to invention scope. If the second current difference value is larger than the fourth current threshold value, the motor 820 is determined being operated abnormally, and next step S424 is performed. Otherwise, the motor 820 is determined being operated normally.

Preferably, because the motor 820 is in stable operation status, the fourth current threshold value is set smaller than the third current threshold value corresponding to starting status to increase determination accuracy.

Please be noted that steps S300-S304 in FIG. 12 and steps S400-S424 in FIG. 13A and FIG. 13B are performed in parallel with steps S204-S216 in FIG. 10. There is no limitation on the sequence order.

Besides, there is no limitation on sequence order among steps S404, S406, S408 and S410 in FIG. 13A and FIG. 13B. There is no limitation on sequence order among steps S404, S418 and S420.

Figure 14:
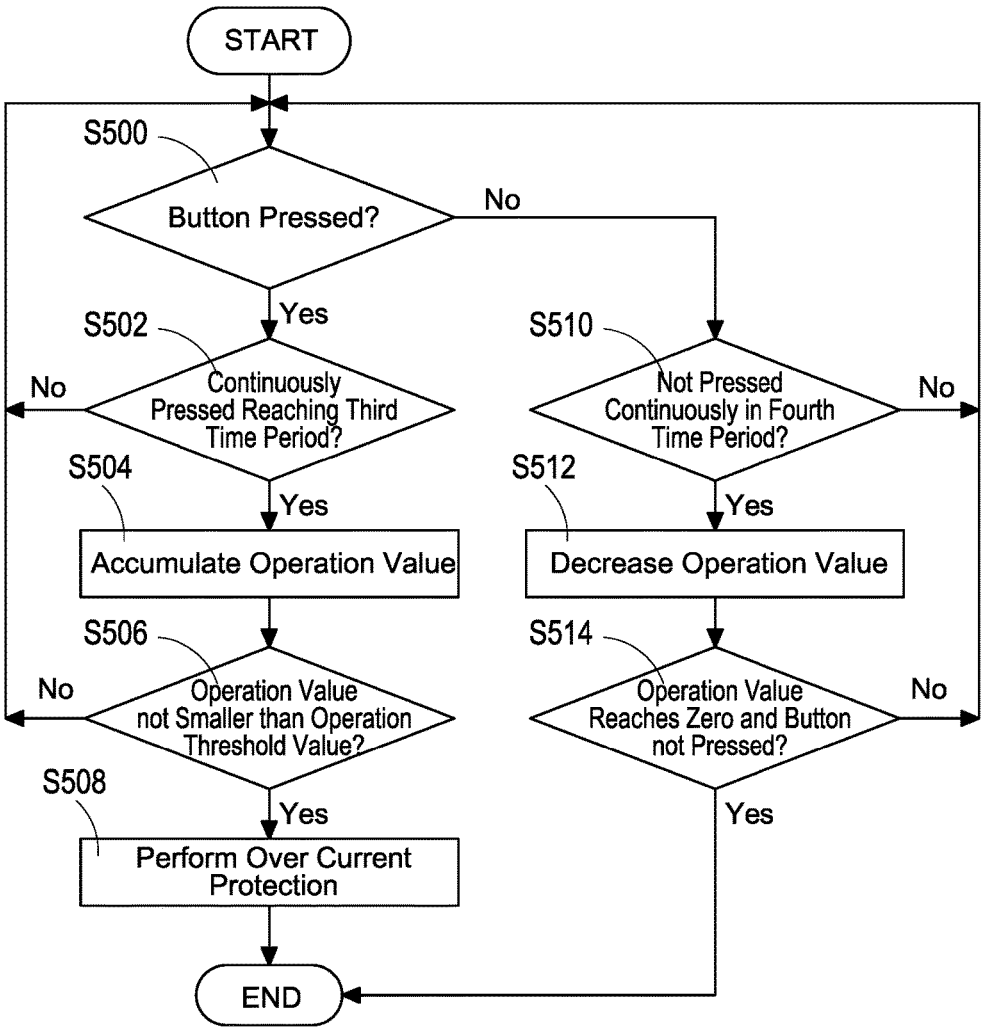
FIG. 14 is a partial flowchart of a control method of the electrical adjustable table in the eighth embodiment according to the present invention.

Please refer to FIG. 8, FIG. 9A, FIG. 9B, FIG. 10 and FIG. 14. FIG. 14 is a partial flowchart of a control method of an electrical adjustable table in the eighth embodiment according to the present invention. In the present invention, users may press continuously the corresponding button on the hand control device 84 to control the table foot 86 to extend or shrink. In the embodiment, the control box 80 determines whether there is over-operated problem by checking pressing status of the corresponding button on the hand control device 84. The embodiment may include following steps for implement over-operated protection function.

In step S500, the control box 80 detects whether a button of the hand control device 84 for triggering the table foot control signal. If the button is pressed, corresponding function is performed and step S502 is performed at the same time. Otherwise, step S510 is performed.

In step S502, the control box 80 determines whether the button is continuously pressed over a third time period like 1 second. If the button is determined pressed reaching the third time period, step S504 is performed. Otherwise, step S500 is performed to perform continuous monitoring.

In step S504, the control box 80 accumulates an operating value, e.g. adding one to the operating value.

In step S506, the control box determines whether the operating value is not smaller than an operating threshold value like 300. If the operating value is not smaller than the operating threshold value, step S508 is performed. Otherwise, step S500 is performed to perform continuous monitoring.

In step S508, the control box 80 performs an over-operated protection mechanism. Preferably, the over-protected protection mechanism is to send a warning message, e.g. generating a warning light via an indicator or generating a warning sound via a beeper, or to stop controlling the driver module 82 according to the table foot control signal, e.g. not to perform corresponding operating by the control box 80.

In step S500, if the button is not detected being pressed, step S510 is performed.

In step S510, the control box 80 determines whether the button continues not being pressed for a fourth time period like 4 seconds. If the button is determined not pressed at all in the fourth time period, step S512 is performed. Otherwise, step S500 is performed for continuous monitoring.

In step S512, the control box 80 decreases the operation value, like to minus 1 from the operation value.

In step S514, the control box 80 determines whether the operation value is returning to zero and the button is not pressed. If the operation value is returning to zero and the button is not pressed, the control method of the electrical adjustable table is ended. Otherwise, step S500 is performed for continuous monitoring.

By such, the present invention effectively prevents frequent operation in short time period to cause components in the electrical adjustable table 1 being damaged.

Please be noted that steps S500-S512 in FIG. 14 may be performed in parallel to steps S200-S16 and there is no limitation on their sequence order.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

The invention claimed is:

1. An electrical adjustable table (10, 10', 8), comprising:

a table plate (13, 13', 88);

at least one table foot (11, 11', 86) connected to the table plate (13, 13', 88) and configured to be moved together with the table plate (13, 13', 88);

a lifting structure (30) disposed in each of the at least one table foot (11, 11', 86) for extending or shrinking each of the at least one table foot (11, 11', 86) to adjust the height of the table plate;

a hand control device (25, 84) for receiving an operation;

a motion sensor unit (23) used to sense a tilt angle of the table plate (13, 13', 88), wherein the motion sensor unit (23) is a gyroscope or an accelerometer sensor; and a control box (20, 80) being disposed to the table plate (13, 13', 88) and being electrically connected to the lifting structure (30), the hand control device (25, 84) and the motion sensor unit (23), the control box (20, 80) being configured to drive the lifting structure (30) to adjust the height of the table plate (13, 13', 88) heading to a first direction according to the operation, and further being configured to stop driving the lifting structure (30) for stopping adjusting the height of the table plate (13, 13', 88) when sensing the table plate (13, 13', 88) tilted via the motion sensor unit during adjusting the height of the table plate, the control box (20, 80) being configured to drive the lifting structure (30) to lower down the height of the table plate (13, 13', 88) when the table plate (13, 13', 88) is in a static status and the tilt angle is not smaller than an angle setting value.

2. The electrical adjustable table (10, 10', 8) of claim 1, wherein the control box (20, 80) comprises a main power unit (21), a main control unit (22) and a warning unit (24).

3. The electrical adjustable table of claim 1, wherein the control box (10, 10', 8) is configured to determine the table plate (13, 13', 88) is tilted when the tilt angle is not smaller than 0.3 degree.

4. The electrical adjustable table (10, 10', 8) of claim 1, further comprising at least one obstacle sensor unit (26) for sensing an obstacle, the obstacle sensor unit (26) being disposed to the table plate (13, 13', 88) and electrically connected to the control box (20, 80).

5. The electrical adjustable table of claim 4, wherein the obstacle sensor unit (26) is a light sensor element.

6. The electrical adjustable table (10, 10', 8) of claim 1, wherein each of the at least one table foot (11, 11', 86) has a table foot plate (111, 111'), and the electrical adjustable table further comprises a table foot plate driving structure (60) connected to a motor (50,820) electrically connected to the control box (20, 80) and disposed in the table foot plate (111, 111').

7. The electrical adjustable table (10, 10', 8) of claim 1, wherein one side of one of the at least one table foot (11, 11', 86) is connected to a beam (12, 12') supporting the table plate (13, 13', 88).

8. The electrical adjustable table (10, 10', 8) of claim 7, further comprising a horizontal moving structure (40) disposed between the beam (12, 12') and the table plate (13, 13', 88), the horizontal moving structure being connected to a motor (50,820) electrically connected to the control box (20, 80) for adjusting the position of the table plate (13, 13', 88) horizontally.

9. The electrical adjustable table (10, 10', 8) of claim 1, wherein the hand control device (25) is embedded in the table plate (13, 13', 88).

10. The electrical adjustable table (10, 10', 8) of claim 9, wherein the hand control device (25) is at the same height with the table plate (13, 13', 88).

11. The electrical adjustable table (10, 10', 8) of claim 9, wherein the hand control device (25) further comprises a touch screen (251) or at least one button (252).

12. The electrical adjustable table (10, 10', 8) of claim 9, wherein the hand control device (25) further comprises at least one touch screen (251) and at least one button (252).

13. The electrical adjustable table (10, 10', 8) of claim 12, wherein the touch screen (251) and the button (252) are disposed at different sides of the hand control device, and wherein the touch screen (251) and the button (252) are respectively disposed at a top surface of the hand control device (25) and an adjacent surface adjacent to the top surface.

* * * * *